US010706663B2

(12) United States Patent
Efremescu

(10) Patent No.: US 10,706,663 B2
(45) Date of Patent: Jul. 7, 2020

(54) GAMING MACHINE HAVING GAUGES THAT DISPLAYS SPATIAL ATTRIBUTES OF WINNING COMBINATIONS

(71) Applicant: Novomatic AG, Gumpoldskirchen (AT)

(72) Inventor: Radu Efremescu, Vienna (AT)

(73) Assignee: Novomatic AG, Gumpoldskirchen (AT)

( * ) Notice: Subject to any disclaimer, the term of this patent is extended or adjusted under 35 U.S.C. 154(b) by 2 days.

(21) Appl. No.: 15/890,283

(22) Filed: Feb. 6, 2018

(65) Prior Publication Data

US 2019/0244472 A1 Aug. 8, 2019

Related U.S. Application Data

(63) Continuation of application No. 15/425,929, filed on Feb. 6, 2017.

(51) Int. Cl.
*G07F 17/32* (2006.01)
*G07F 17/34* (2006.01)

(52) U.S. Cl.
CPC ..... *G07F 17/3213* (2013.01); *G07F 17/3239* (2013.01); *G07F 17/34* (2013.01)

(58) Field of Classification Search
CPC ... G07F 17/3213; G07F 17/3239; G07F 17/34
See application file for complete search history.

(56) References Cited

U.S. PATENT DOCUMENTS 6,159,098 A 12/2000 Slomiany et al.
6,346,043 B1 2/2002 Colin et al.
6,494,785 B1 12/2002 Gerrard et al.
6,602,136 B1 8/2003 Baerlocher et al.
6,609,972 B2 8/2003 Seelig et al.
6,857,958 B2 2/2005 Osawa
7,867,077 B2 1/2011 Baerlocher et al.
8,002,620 B2 8/2011 Nicely et al.
(Continued)

FOREIGN PATENT DOCUMENTS

GB 2353128 2/2001

OTHER PUBLICATIONS

Office Action for 15/425,929 dated May 11, 2018; 17 pps.
(Continued)

*Primary Examiner* — James S. McClellan
*Assistant Examiner* — Peter J Iannuzzi
(74) *Attorney, Agent, or Firm* — Fincham Downs LLC; Magdalena M. Fincham, Esq.

(57) ABSTRACT

A system and method for presenting data pertaining to win streak length and spatial origin of winning combinations during slot machine game play. The system includes a kiosk for housing a computer assembly operatively connected with a primary display having a right gauge on a right side and a left gauge on a left side. The gaming machine accepts a payment to initiate slot machine game play and randomly presents a array of symbols on the display. The array of symbols includes a left column, a right column, and a column adjacent to each of the right column and the left column. The display presents a first winning combination of corresponding symbols having a first spatial origin and a second winning combination of corresponding symbols having a second spatial origin. The gauges display winning combinations and the spatial origin of each winning combination.

14 Claims, 7 Drawing Sheets

(56) References Cited

U.S. PATENT DOCUMENTS

| | | | | |
|---|---|---|---|---|
| 8,784,174 | B2 | 7/2014 | Basallo et al. | |
| 8,840,456 | B2 | 9/2014 | Basallo et al. | |
| 9,082,261 | B2 | 7/2015 | Caputo et al. | |
| 9,569,932 | B2 | 2/2017 | Nicely et al. | |
| 2002/0010018 | A1 | 1/2002 | Lemay et al. | |
| 2002/0155881 | A1* | 10/2002 | Yoshida | G07F 17/32 463/20 |
| 2003/0036430 | A1 | 2/2003 | Cannon | |
| 2004/0116179 | A1 | 6/2004 | Nicely et al. | |
| 2005/0003880 | A1 | 1/2005 | Englman et al. | |
| 2005/0049033 | A1* | 3/2005 | Kojima | G07F 17/3211 463/20 |
| 2005/0159200 | A1* | 7/2005 | Nicely | G07F 17/32 463/16 |
| 2006/0017225 | A1 | 1/2006 | Nicely | |
| 2006/0066051 | A1 | 3/2006 | Nicely | |
| 2007/0054726 | A1* | 3/2007 | Muir | G07F 17/3262 463/16 |
| 2007/0135193 | A1 | 6/2007 | Nicely | |
| 2010/0029381 | A1 | 2/2010 | Vancura | |
| 2011/0003627 | A1* | 1/2011 | Nicely | G07F 17/3244 463/20 |
| 2011/0003637 | A1 | 1/2011 | LeFever | |
| 2011/0098101 | A1 | 4/2011 | Gomez et al. | |

OTHER PUBLICATIONS

Final Office Action for 15/425,929 dated Jan. 11, 2019; 21 pps.
Office Action for 15/425,929 dated Sep. 24, 2019; 11 pps.
Final Office Action for 15/425,929 dated Dec. 23, 2019; 13 pps.
Advisory Action for 15/425,929 dated Mar. 26, 2020; 3 pps.
AFCP Decision for 15/425,929 dated Mar. 26, 2020; 1 pps.
Interview Summary for 15/425,929 dated Mar. 27, 2020; 5 pps.

* cited by examiner

GAMING MACHINE HAVING GAUGES THAT DISPLAYS SPATIAL ATTRIBUTES OF WINNING COMBINATIONS

CLAIM OF PRIORITY

The present application claims priority of U.S. application Ser. No. 15/425,929, filed Feb. 6, 2017 in the name of Radu Efremescu and titled GAMING MACHINE HAVING GAUGES THAT DISPLAYS SPATIAL ATTRIBUTES OF WINNING COMBINATIONS. The entirety of this application is incorporated by reference herein for all purposes.

STATEMENT OF COPYRIGHTED MATERIAL

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyrights whatsoever.

FIELD OF THE INVENTION

The invention pertains to gaming machines including slot machines, and particularly to slot machines having gauges that tally the number of winning combinations of a winning streak.

BACKGROUND OF THE INVENTION

In the gaming machine industry, there is a continuing need for gaming machine manufacturers to produce new types of games and enhancements to existing games. One industry goal is to attract frequent play by enhancing the entertainment value and excitement associated with the game.

Entertainment value is at least partly explainable in terms of neurological response to a gaming machine interface. Movement and presentation of symbols as seen in slot machine game play have entertainment value for a player. The way that human eyes perceive movement and positioning, and other symbol characteristics influences the entertainment experience. More specifically, visual stimuli may trigger varied neurological responses that some report as excitement.

Although optical neurological research is in its infancy, it is known that visual stimuli is converted from light to signals in the retina and the signals are communicated via the optic nerve of each eye. At one point the optic nerve fibers cross at the optic chiasm where some of the signals from the left eye are communicated to the right hemisphere of the brain, and some signals from the right eye are communicated to the left hemisphere of the brain. The optic chiasm also has pathways that do not cross the signals between hemispheres. Thus, each hemisphere of the brain obtains sensory input from both eyes. The visual sensory signals influence many parts of the brain including the lateral geniculate bodies which communicates with the cerebral cortex and the brainstem reticular formation, which plays some role in attention or arousal. Researchers indicate that many complex movement-sensitive cells of the striate cortex of the brain respond better to stimuli from one direction than to stimuli from the diametrically opposite direction. It has been observed that one direction of movement can produce a lively response in these cells and movement from another direction may yield no response at all.

During slot machine play a set of reels containing symbols spin. The reels initially were mechanical, but modern machines have virtual reels that appear as a matrix of symbols in rows and columns. After a brief period these reels stop spinning, typically from left to right. When all of the reels stop paylines can be identified and displayed across the reels based on the symbols distribution on the matrix of symbols. The payline identification and display are based on a pay table. The paylines may vary in configuration depending on the particular gaming machine and the configuration of the cabinet that the machine that houses the interface on which the reels are displayed.

U.S. Pat. No. 8,641,044 to Gruber discloses paylines can be read from right to left or left to right without changing the probabilities of winning. In this way, if a predetermined number of related symbols appear in alignment on the right side of the interface, a payline can be determined from the right side. Similarly, if a predetermined number of related symbols appear in alignment on the left side, then a payline can be determined from the left side. According to Gruber, the player is offered the option to pre-select which payline approach, or approaches, to utilize prior to commencement of a reel-spin. It is suspected that certain persons can achieve a higher degree of entertainment value when paylines are determined by this selective right-or-left approach.

While the Gruber invention adds to the art of slot machine play, there is still a need to keep players interested, stimulated and to deliver ever-improving entertainment value to the players.

SUMMARY OF THE INVENTION

The present invention includes a gaming machine respectively electronic gaming machine ("EGM") designed for slot-machine game play including presenting data pertaining to win streak length and spatial origin of winning combinations. The gaming machine includes a kiosk for housing a computer assembly. The kiosk houses and operatively connects the computer assembly with a primary display, a coin acceptor, a card reader and a coin tray. The coin acceptor and card reader accept payments. The card reader and the coin tray credit or dispense payments.

The display has right side and a left side with a right gauge on the right side and a left gauge on the left side. The display presents a matrix of symbols between the gauges. The matrix of symbols can be an array or other configuration of conglomerated symbols. In one embodiment, the matrix has a fixed number of columns and a fixed number of rows, for example. The matrix of symbols has, for example, five columns and three rows to enable slot-machine game play. In another embodiment the matrix of symbols includes a left column, a right column, and a column adjacent to each of the right column and left column. The matrix of symbols thus, yields the possibility of winning combinations of symbols defined by a payline across the various columns.

In accordance with embodiments in which the game is a wagering game, game play may be initiated when the player places an initial wager to play. In embodiments implemented on an EGM or otherwise utilizing a random number generator ("RNG"), after a game play is initiated via an input device, a control unit—in some embodiments using or working with a random number generator ("RNG")—generates an outcome. That outcome is displayed on the display of the EGM to the player. Usually, the outcome is displayed in the form of a symbol array as described herein. Embodiments described herein may be implemented in a base game, a sub-game, a bonus or a free game after detecting a trigger event (e.g. during the process of the current game play or in the outcome of the game play).

When game play includes at least a first reel set spin and a second reel set spin having winning combinations of symbols, a win streak is yielded. With each winning combination a payline is formed revealing the winning combination of corresponding symbols. A payline logic circuitry may be provided for evaluating the symbols displayed in the matrix. The payline logic is stored in digital form by the machine and includes a defined pay table that determines paylines. The payline logic circuitry in this case is also adapted to provide the spatial origin of the symbols matching to a payline defined in the pay table. In another embodiment, the defined pay table can be updated, reprogrammed and otherwise modified such as for example during a software, firmware or hardware update. Utilizing a defined pay table simplifies payline calculations.

Hence, depending on the output of the payline logic circuitry, when the winning combination of the corresponding symbols includes the corresponding symbols being in adjacent positions having a spatial origin on the left side of the matrix of symbols then the left gauge is activated and likewise when the winning combination of corresponding symbols includes the corresponding symbols being in adjacent positions having a spatial origin on the right side of the matrix of symbols then the right gauge is activated. Each of the bonus gauges is tied to the respective winning lines: the left gauge tied to the left-to-right winning lines and the right gauge tied to the right-to-left winning lines.

The left gauge and the right gauge cooperate to tally win streak data resulting from a sequence of winning combinations. In particular the win streak data is tallied by spatial origin of the winning combination of symbols and win streak length.

In one embodiment of the invention the matrix of symbols has columns that appear to rotate in a vertical sequence. Each column rotates independently of the others and each column stops at a different time. The right and left columns stop rotating first, then columns adjacent these outer columns stop rotating. Then columns in the center of the matrix of symbols stop rotating last.

The left gauge and right gauge have bars, respectively, for tallying win streak data. One bar activates in response to a winning combination of corresponding symbols is presented.

According to one embodiment, every time a winning line pays out, the corresponding associated (left respectively right) gauge is advanced by one unit. When a winning line is triggered belonging to both, the left and right side at the same time, this is considered a tie and neither gauge is advanced. Alternatively, both gauges are advanced, if math model allows it.

The left gauge and right gauge include unlock indicators in vertical alignment with the respective bars, activation of a predetermined number of bars activates at least one of the unlock indicators, activation of an unlock indicator enables a bonus possibility during game play.

According to one embodiment, if a bonus milestone (unlock indicator) is reached with the respective gauge, this milestone is automatically triggered and persists until no wins are scored on that side.

In an embodiment of the invention, five bars unlock a single unlock indicator. The gaming machine has four unlock indicators on each of the right and left gauge.

The spatial origin data tallied and displayed by the gaming machine is selected from the group consisting of: the right side of the matrix of symbols, the left side of the matrix of symbols and combinations thereof.

BRIEF DESCRIPTION OF THE DRAWINGS

The drawings disclose the present invention by way of illustrated examples, but are not intended to limit the scope of the invention.

DETAILED DESCRIPTION

Figure 1:
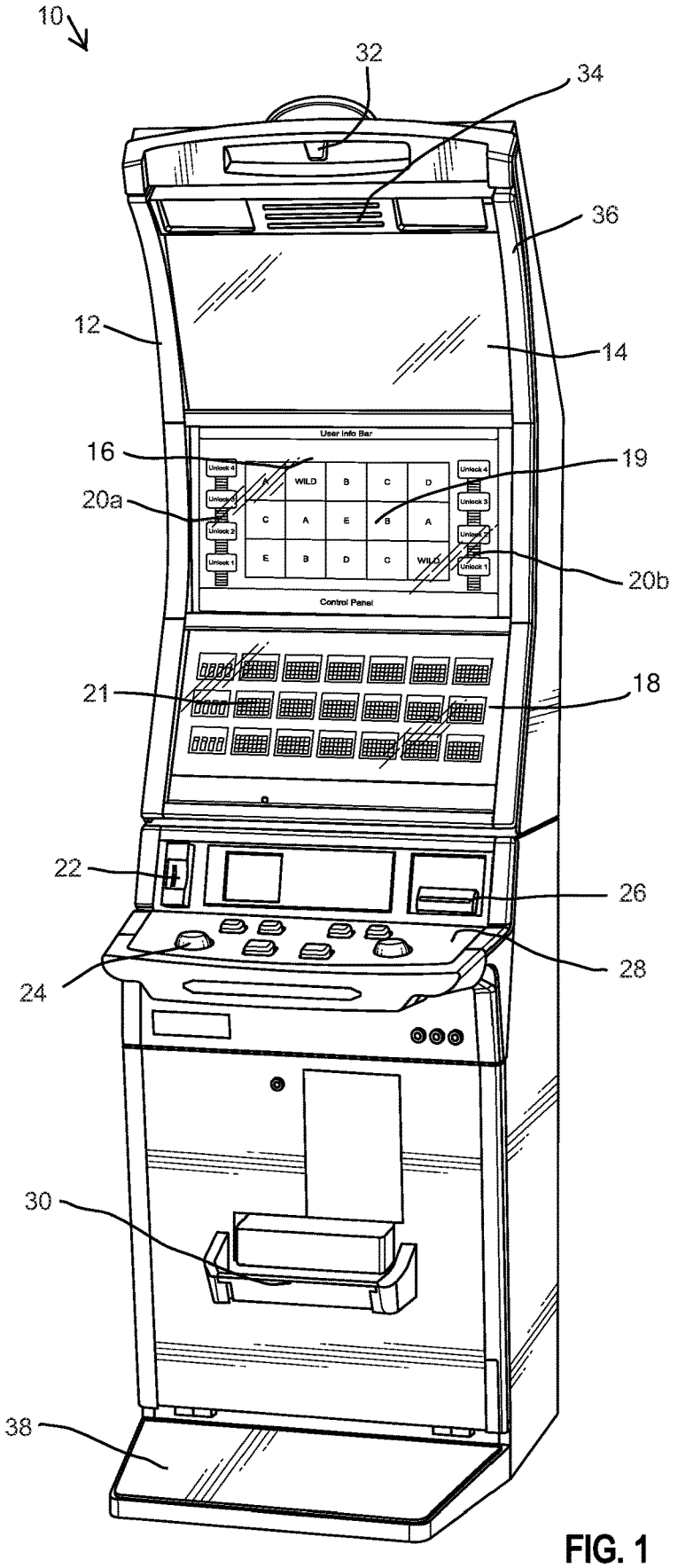
FIG. 1 is a perspective view of a gaming machine in accordance with the present invention.

FIG. 1 shows a gaming machine generally designated with the reference numeral 10. The gaming machine 10 includes a kiosk 12 including a housing for holding components of the gaming machine 10. The kiosk 12 includes an upper display 14, a main display 16, and a lower display 18. Preferably the gaming machine 10 is a slot machine having physical or virtual reel sets 19. Each reel set 19 includes columns and rows. The reel set 19 shown includes a matrix of symbols having three rows and five columns.

In an embodiment of the gaming machine 10 having virtual reel sets, a virtual reel set is presented on the main display 16 as a matrix of symbols. It can be appreciated that slot machine game play and matrices of symbols can also be presented on the upper display 14 and the lower display 18 as well as various gaming themes, animation, and lighting.

In one embodiment of the gaming machine 10 the lower display 18 includes array of images or icons offering various games to a user. In one embodiment of the invention a user (player) selects one icon 21 to selectively initiate game play of one out of a number of games.

The kiosk 12 further includes a coin receiver slot 22, a card reader 26, a tactile interface 28 with buttons 24 for enabling game play, and coin dispenser tray 30. The coin receiver slot 22 is configured for receiving tokens or coins which are typically round in shape and made from a metallic material to enable detection by a token detector within the gaming machine 10. The card reader 26 is configured to receive funds and dispense funds electronically. The kiosk 12 is designed for casino-style slot machine play. It can be appreciated that the kiosk can assume a number of other configurations that are used for slot machine games. Slot machine play is characterized by spinning reels that stop to generate a random array of symbols. The reels may be formed as images of columns on a matrix of symbols. Winning combinations of symbols are highlighted by a payline that continuously extends across the winning combinations of symbols and the matrix of symbols.

In one embodiment depositing a coin or token into the coin receiver slot 22 activates the coin detector and initiates game play. The coin receiver slot accepts payments. Winnings, change and other payments are dispensed via the coin dispenser tray 30.

The card reader 26 is configured to read smart cards, cards with a magnetic strip, and gaming tickets including a bar code, or data matrix type bar code. Accordingly, the card reader 26 is equipped with at least one or more of: an RFID reader, a magnetic strip reader, and an optical reader for reading bar codes. In one embodiment of the invention, insertion of a card into the card reader 26 initiates game play.

The card reader 26 is capable of accepting and dispensing payments. In one embodiment, the card reader 26 includes a printer in one embodiment of the invention so that when a gaming ticket including bar code is inserted into the ticket reader 26 to initiate game play, a replacement or updated ticket can be returned via the card reader when game play is completed. The replacement or updated ticket includes updated information encoded on the ticket so that the ticket can be used again with the updated information to initiate game play in the kiosk 12 or other nearby game.

It can be appreciated that the card reader 26 can be substituted by, or supplemented by, other optical or near field communications devices that enable a user to initiate game play and that record the results of the game play including payouts. A bill acceptor can be included in the kiosk 12 of the present invention.

In various embodiments of the invention ways of dispensing and accepting payments can also include biometric identification devices that replace or supplement coin slots, bill acceptors, coin acceptors or card readers. A biometric identification device may include a fingerprint reader, a retina pattern detection device, or a facial recognition device, for example.

The coin dispenser tray 30 dispenses payments in the form of coins or tokens. In one embodiment of the invention winnings are dispensed in the form of metallic tokens or coins to enhance the sensation of winning. In another embodiment the combination of sound and light are emitted from the kiosk 12 to enhance the sensation of winning.

The kiosk 12 is upright in configuration to enable a player to stand or sit within reach the tactile interface 28. The player operates games presented on the kiosk through the tactile interface 28 or by touching the main display 16. A foot rest 38 is attached to a bottom portion of the kiosk 12 to enable a standing or sitting person to more comfortable rest at least one foot. The foot rest 38 is important for players that play for long periods of time exceeding 20 minutes so that the player can maintain comfort. The foot rest is sloped down from the kiosk 12 in a direction outwards from the kiosk 12 and tactile interface 28. This provides both ergonomic foot support and wheelchair access.

The kiosk 12 includes a light 32, and a speaker 34 mounted on a top portion of the kiosk 12 for flashing and sounding, respectively as part of a notification system that is activated upon a winning reel spin, or other noteworthy wining event. The kiosk 12 is further equipped with edge lighting 36 that activates both passively and in response to a noteworthy winning event such as the achievement of a winning combination of symbols in the matrix of symbols. The edge lighting 36 forms a portion of a bezel that surrounds at least a part or more of the upper display 14, the main display 16 and the lower display 21.

While the kiosk 12 may include an upright housing as described, numerous variations of the present invention can be assembled. For example the kiosk may be integrated into table top, or multi-element kiosk having seating and multiple displays that communicate, yet are not physically attached to each other, may be assembled. Further, while three displays are present, each at an angle from the adjacent display, the present invention can be implemented on a kiosk 12 having only a main display. Further the displays can be configured as a single display having digitally segregated portions. The displays may include touch screen technology to supplement or replace the tactile interface 28.

Figure 2:
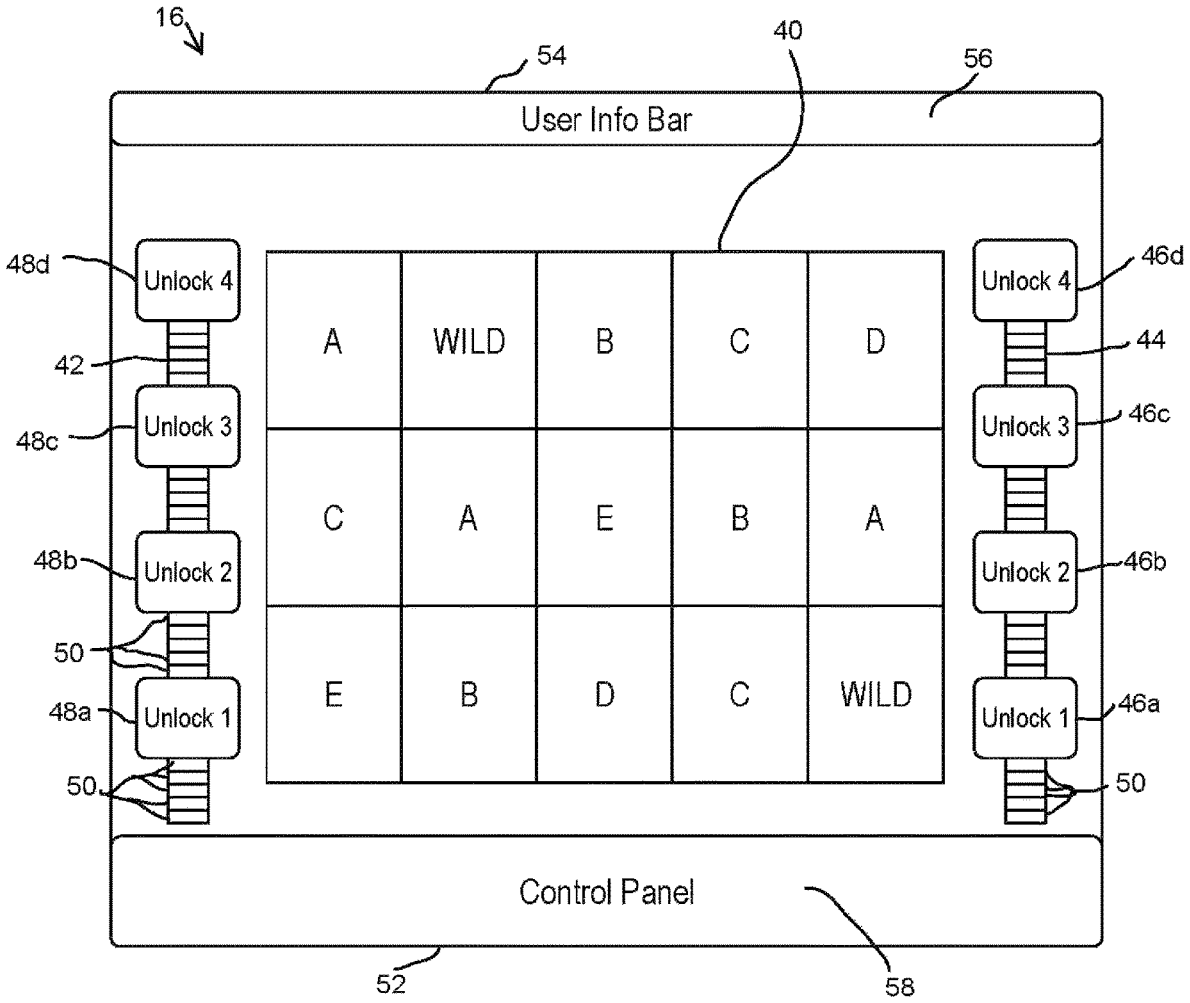
FIG. 2 is a screenshot of a game displayed on the gaming machine of FIG. 1.

FIG. 2 shows the main display 16 having a matrix of symbols representing a reel set 40, a left gauge 42 and a right gauge 44.

The matrix of symbols 40 has five columns and four rows presented centrally on the main display 16. Upon activation of a slot machine game, the columns appear to move in a vertical fashion in an upwards or downwards direction to imitate physical reels of a slot machine. Each column operates independently of the others so that the timing of the movement of the columns is presented according to a predetermined timing.

The right gauge 44 includes four unlock indicators 46*a-d*. The left gauge 42 includes four unlock indicators 48*a-d*. The gauges 42 and 44 are illuminated from bottom to top in accordance with game play rules.

The gauges 42 and 44 display sets of bars vertically aligned with bars 50 interposed between adjacent unlock indicators and vertically aligned under the respective unlock indicator 48*a*-48*d* and 46*a*-46*d*. The bars 50 are selectively illuminated or otherwise highlighted in response to a winning combination of the game. A winning streak causes a sequence of bars to illuminate in response to a streak of winning combinations. Preferably, each win in a winning streak illuminates one of the bars. When the sequence reaches certain threshold values, such as five, an unlock indicator is activated by illumination or other highlighting mechanism.

There are a total of four unlock indicators on each gauge 42, 46 that are vertically aligned with a respective series of bars 50. In the current embodiment a total of forty bars may be highlighted (twenty on each side) and a total of eight unlock indicators (four on each side of the matrix of symbols).

When each unlock indicator is activated it changes the game by increasing the possibility and type of paylines that yield a winning combination for the matrix of symbols during game play. In another embodiment, an activated unlock indicator increases the probabilities of enablement of a bonus feature. In another embodiment an active unlock indicator increases the payout of existing game play rules such as by affording a multiplier that yields an increased payout or game credits. A combination of any number of these embodiments are implemented in variations of game play.

Payouts, or other rewards, increase with the number of unlock indicators that are active (e.g. highlighted). The greater the number of unlock indicators active on a common side, the payouts and other rewards for winning combinations beginning on that side increase for each additional winning combination.

The unlock indicators 46*a-d* and 48*a-d* are displayed in the form of images appearing on the right and left gauges 44 and 42, respectively. The images may be animated, brightly lit, or flashing, for example. The term "bar" is to be understood broadly to encompass any shape, icon or image that may communicate a tally to a game player.

Each unlock indicator is activated by illumination. Such activation may appear in a vertical sequence starting with the unlock indicator near the bottom 52 and continuing with the subsequent unlock indicator appearing towards the top 54 of the main display 16.

On the top of the display 16 is a user information bar 56 and on the bottom of the display is a control panel 58. The control panel 58 includes touch screen technology embedded in or on the main display 16 to enable touch screen input hence acting as an input device.

Figure 3:
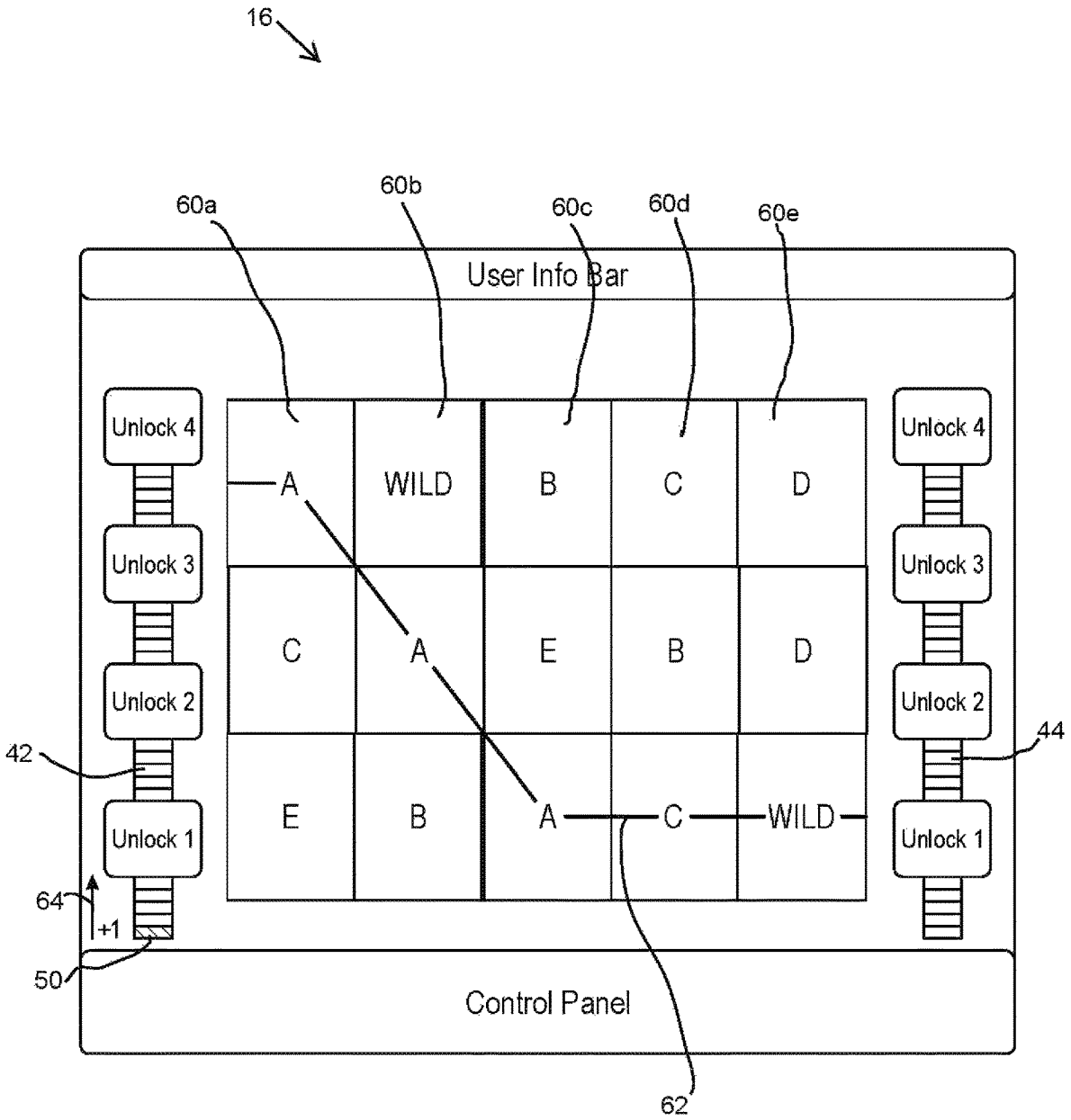
FIG. 3 is a screenshot of a game displayed on the gaming machine of FIG. 1.

FIG. 3 shows the main display 16 having left to right winning combination. The matrix of symbols includes columns 60*a-d*. The winning combination begins from the first column 60*a*, which is on the left side of the matrix of symbols. The winning combination includes an alignment of three corresponding symbols of the same type. It can be appreciated that the alignment may include additional corresponding symbols across three or more reels. This yields the possibility of a five symbol win on a gaming machine having five reels, or a matrix of symbols having five columns. A payline 62 extends across the columns 60*a-d* and is drawn with a dark broken line. The payline 62 in other embodiments is a continuous line that overwrites symbol. It may be a solid or flashing line with various forms of highlighting. Further numerous paylines 62 may be presented depending on game play rules.

The payline 62 and the matrix of symbols are depicted on the main display 16. The payline 62 is shown in broken line view to reveal underlying symbols. According to exemplary game rules, an alignment of three corresponding symbols yields a payline. In this case there is a diagonal alignment of a series of three "A" symbols. The alignment may be horizontal, diagonal in a single direction, or diagonal in a zigzag fashion where a number of diagonal lines achieve a payline. The payline 62 thus may be horizontal, diagonal in a single direction, or diagonal in a zigzag fashion or a mixture of horizontal and diagonal. The payline 62, thus may be a combination of lines that track various directions and angles in various aspects of the invention.

These "A" symbols correspond to each other because they are the same, symbols of a same type may also correspond to each other. For example, the letter "A" may be presented in different ways, but the letter is the type "A". Further, symbols can correspond to each other by depicting a type of device, image, animal, person, avatar, symbol, etc., and while such symbols are not the same, they could be of the same type.

The symbols read from left to right in this embodiment. The first "A" appears in the left column, the second "A" appears in an adjacent column to the left column. The third "A" appears in a next column adjacent to the column where the second "A" appears.

While corresponding symbols typically are duplicates of each other, symbols may correspond in ways other than sameness. Wild symbols may correspond to all other symbols and may substitute for a missing symbol to complete a winning symbol combination. An icon may correspond to other similar icons. A video icon may correspond to other video icons by virtue of its presentation method i.e. video.

The alignment of three corresponding symbols yields a winning combination.

Since the symbols include a symbol in the first column 60*a*, which appears on the left side of the matrix of symbols of the main display 16, a record of the winning combination is recorded on the left gauge 42 and presented as a single bar 50 on the gauge 42. This record of winning combinations is tallied on the gauge 42 and gauge 44 until the user stops playing or the game is terminated. Witnessing action such as movement and lights on the left side of a person's visual awareness stimulates a region of the brain associated with such action.

Subsequent wining combinations beginning on the left side of the matrix of symbols are tallied on the left gauge 42 by activating another bar 50 in one bar increments in the direction of the arrow 64.

In some instances the gauges illuminate an unlock indicator absent a winning combination, or upon the appearance of a pre-determined symbol or combination of symbols, such as a wild symbol. This keeps the player interested in continued play.

The following Table 1 is a bonus table that provides examples of what a bonus table might look like and yield an increment of the left or right gauge, respectively. The bonus table is used to modify game play. The tier number is reflective of the current state of the unlock indicators, which have a state ranging from 1-4, depending on the number of winning combinations in a winning streak, and other factors.

TABLE 1

| Tier | Bonus Type - Left Gauge | Bonus Type - Right Gauge |
|---|---|---|
| 1 | Random Low symbol pays 3x | Random symbol is Wild |
| 2 | Random High symbol pays 3x | Random symbol is Expanding Wild |
| 3 | All Low symbols pay 3x | Random symbol is Spreading Wild |
| 4 | All High symbols pay 3x | Wilds multiply line 2x |

Referring to Table 1, upon appearance of a non-winning combination, the gauges are reset to zero. In yet another embodiment, the gauges are decremented upon appearance of a non-winning combination.

In one embodiment of the invention, the left gauge is used to attribute an increased payout in combination with the bonus table. The right gauge has a different function than the left gauge, and in this case regulates how wild symbols effect the game play. When a single unlock is activated a random symbol in the matrix of symbols becomes a wild symbol, when two unlocks are activated, a random symbol is an expanding wild symbol that changes at least one adjacent symbol to a wild symbol. When three unlocks are activated then the wild symbol becomes a spreading wild symbol that changes more than one additional symbol in the matrix of symbols into a wild symbol. When four unlocks are activated then the wild symbol yields a line multiplier. Utilizing bonuses available in Table 1, even where a winning combination is not achieved by a reel spin, supplemental bonuses may be randomly achieved to continue a winning streak.

It may be appreciated that utilizing the right and left sides of the display provide a player an optically intriguing and stimulating experience in a game that typically requires a player to focus only on the middle of the display to watch the matrix of symbols, or reels.

The payline may appear instantaneous, or be drawn from left to right, or right to left. Upon appearance of the payline, the bar is illuminated. The arrow indicates the direction of possible subsequent bar illuminations for a winning combination beginning in the first column will appear.

When the payline focuses the eye of a player on the left side of the display 16 and the left gauge 42 simultaneously or sequentially attracts the players attention on the left side of the display the player is stimulated. Since overstimulation may lead to boredom, the gaming machine provides the possibility to have a payline initiated and tallied at the right side of the display 16. Bars and unlock indicators of the right gauge 44 are positioned on the right side of the display in anticipation of this possibility, which is likely to stimulate the player differently.

The memory storage capacity of the kiosk and computing capability of the computer assembly tally the number of winning combinations and the spatial origin of such combinations, presenting the tally on the display 16 through use of the gauges 42 and 44. Computing and memory storage requirements of the gaming machine are minimized through the use of the gauges. Further, illuminating the gauges on the main display 16 in response to the tally function, minimize load burden to the computer assembly when managing data reflective of the spatial origin of a payline and number of winning combinations in a winning streak. The left and right gauges easily tally and display both the number of winning combinations in a winning streak and the spatial origin of past winning combinations on the display.

Reel Stop Sequence Combined With Spatial Attributes of Winning Combinations

The present invention provides a way to efficiently tally the spatial attributes, including spatial origin of a winning combination of symbols in a matrix of symbols. Optimally the payline, or paylines appear instantly to reveal a winning combination. To add excitement, one embodiment of the invention includes variants of when each reel or column stops relative to the other columns.

In one embodiment, the stop sequence is from either the right side or left side beginning from the first column 60*a*, or alternatively from the last column 60*e*. In another embodiment the stop sequence is coordinated to have one outside column (60*a* or 60*e*) stop spinning followed by the other, then adjacent columns further towards the center of the matrix of symbols stop spinning (60*b* or 60*d*) with one followed by the other. Finally the inner most column 60*c* stops spinning. In this way the middle column or reel is determinative of whether or not a winning combination results. Additionally, this stop sequence may stimulate a user in an interesting and new way resulting from changing the left/right perception of the game.

The combination of a reel stop sequence from the outside moving inwards and presenting spatial attribute and tally data on the right and left side provides a full range of optical and neurological stimulation to entertain a player for long periods of time.

Figure 4A:
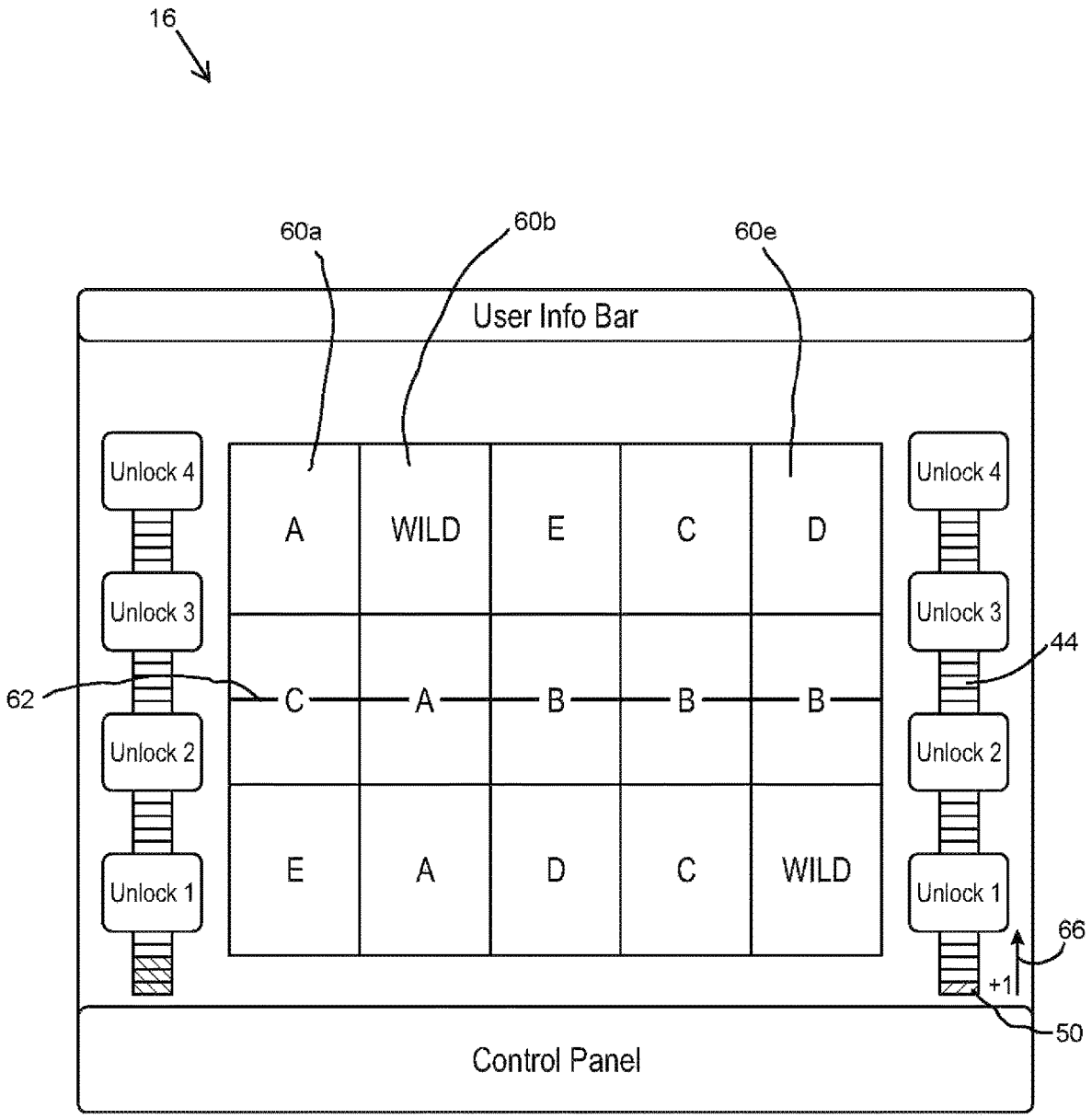
FIG. 4*a-b* are screenshots of a game displayed on the gaming machine of FIG. 1.

FIG. 4*a* shows an example of a winning combination from right to left depicted in the main display 16. The payline 62 extends horizontally across the matrix of symbols. The winning combination begins from the last column 60*e*, which is on the right side of the matrix of symbols.

Here there is an alignment including three corresponding "B" symbols in horizontal alignment. It can be appreciated that the alignment includes additional benign symbols "A" and "C" across the first column 60*a* and second column 60*b*.

The right gauge 44 is incremented by one bar 50, which illuminates to indicate activation. The arrow 66 shows the direction upwards from the bottom of the display where bars may be incremented by subsequent wining combinations. As a result of illumination of the bar 50 on the right side of the display 16 and general activation of the right gauge 44, the player's attention is diverted to the right side of the display 16 to stimulate the player's brain differently than stimulation arising from focusing attention on other regions of the display. The activation of the bar 50 on the right gauge 44 tallies both a winning combination and the spatial origin of the winning combination (on the right side).

Spatial origin is shown associated with the right to left, or left to right, appearance of a winning combination and resulting payline in this embodiment of the invention. However it can be appreciated that the spatial origin may also include spatial orientation, spatial alignment and precise spatial location of symbols yielding a winning combination, a payline, or both. Spatial origin is relative to a fixed position on the display on a gaming machine. In this case, the right or left side of the reel sets, or matrix of symbols, on the display.

Figure 4B:
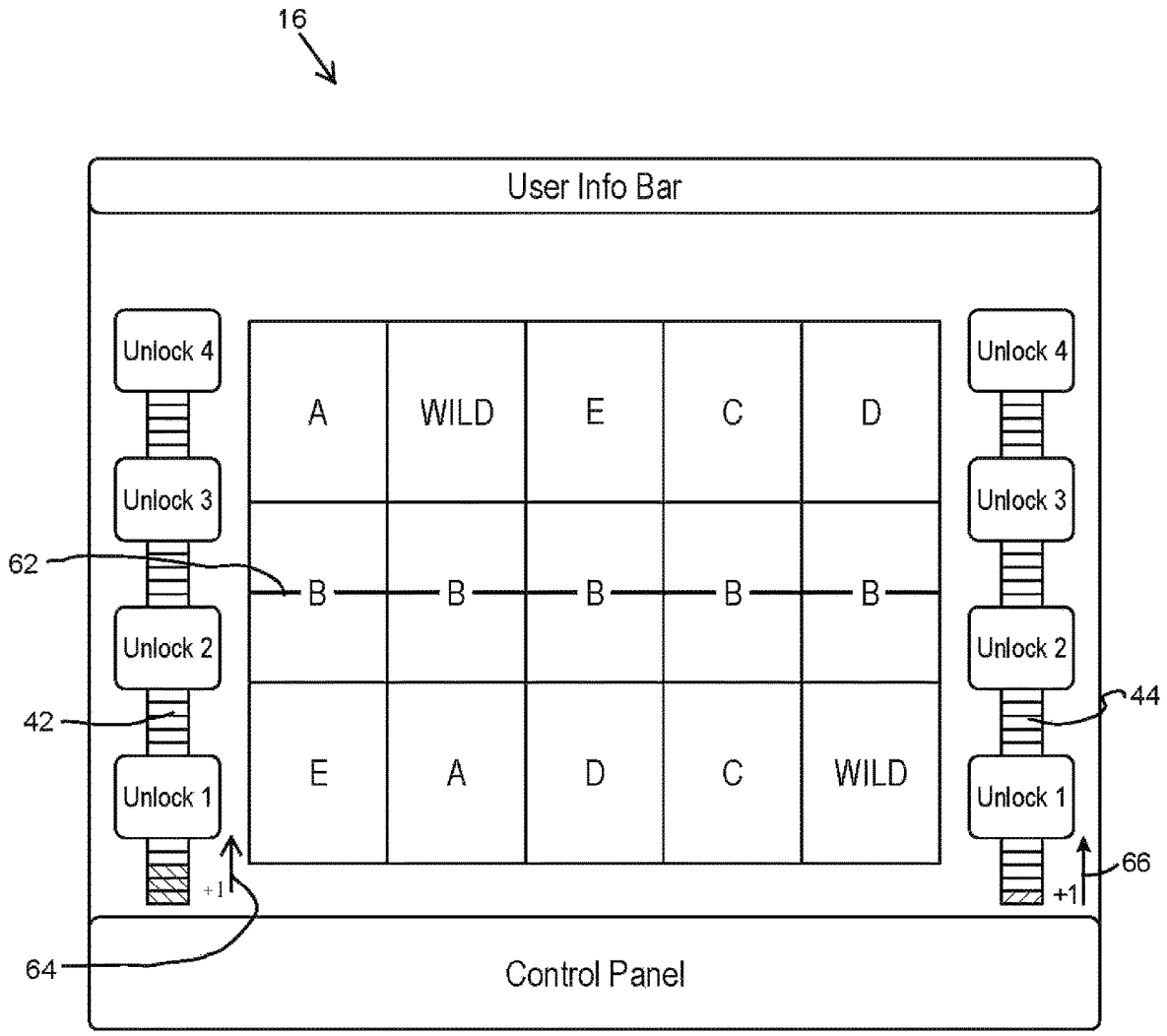

FIG. 4*b* shows the display 16 with a winning combination spanning all reels along the payline 62, which is horizontal. In this embodiment, both gauges 42 and 44 are incremented by one bar as indicated by the arrows 64 and 66. In an alternate embodiment neither gauge is incremented.

Figure 5:
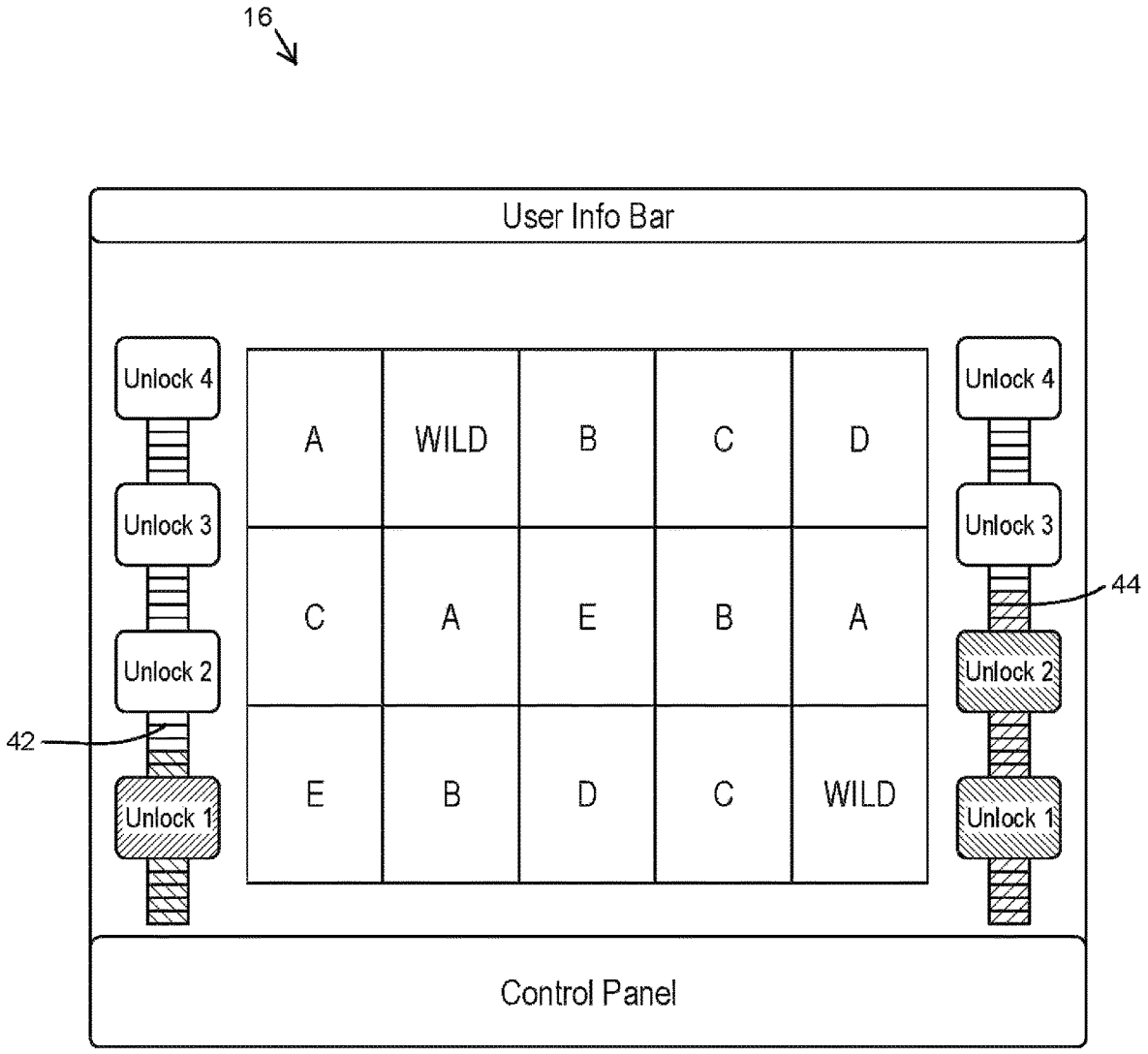
FIG. 5 is a screenshot of a game displayed on the gaming machine of FIG. 1.

FIG. 5 shows a non-winning combination on the display 16 and the current state of the right gauge 44 and the left gauge 42. The appearance of the non-winning combination yields at least two possibilities. The first possibility is that the game terminates, and the second possibility is that a bonus feature is activated. Where the bonus feature is activated, the bonus Table 1, may yield a bonus increase or continue the win streak. One possible bonus feature includes continued game play. Another possible bonus feature is that increased payouts are provided upon termination of game play. In one embodiment, the number of unlock indicators that are activated functions as a bonus multiplier.

Figure 6:
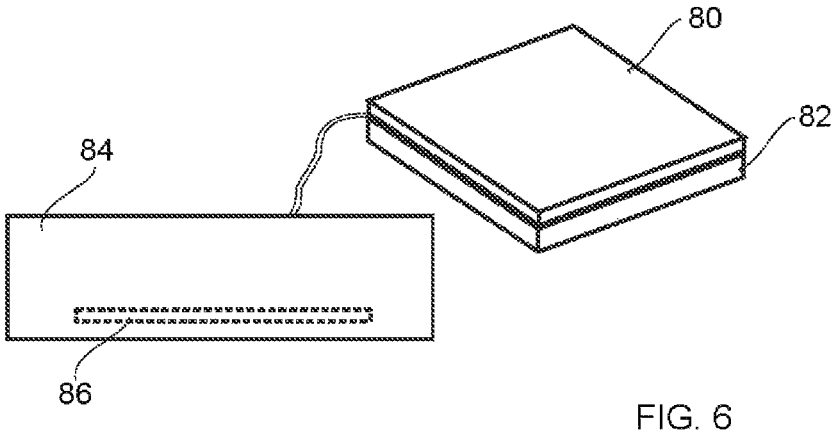
FIG. 6 is a computer assembly in accordance with the present invention.

FIG. 6 shows a computer assembly 84, which mounts in the kiosk 12 of the gaming machine 10. The computer assembly 84 operatively communicates with a display 80. In one embodiment, the display 80 includes at least one transmissive LCD panel and may include an integrated touchscreen 82. The computer assembly 84 includes a main board 86 having a controller, memory connected to the main board for storing software, software stored in the memory for operating the display 80. The main board 86 includes game logic including a payline logic circuitry and a memory that stores a defined pay table. The main board 86 also includes software drivers, and a main processor. In a preferred embodiment, the computer 84 includes three displays 80 including the upper display 12, a main display 16 and a lower display 21 (see FIG. 1). The components of the main board 86 are connected in operative communication.

Figure 7:
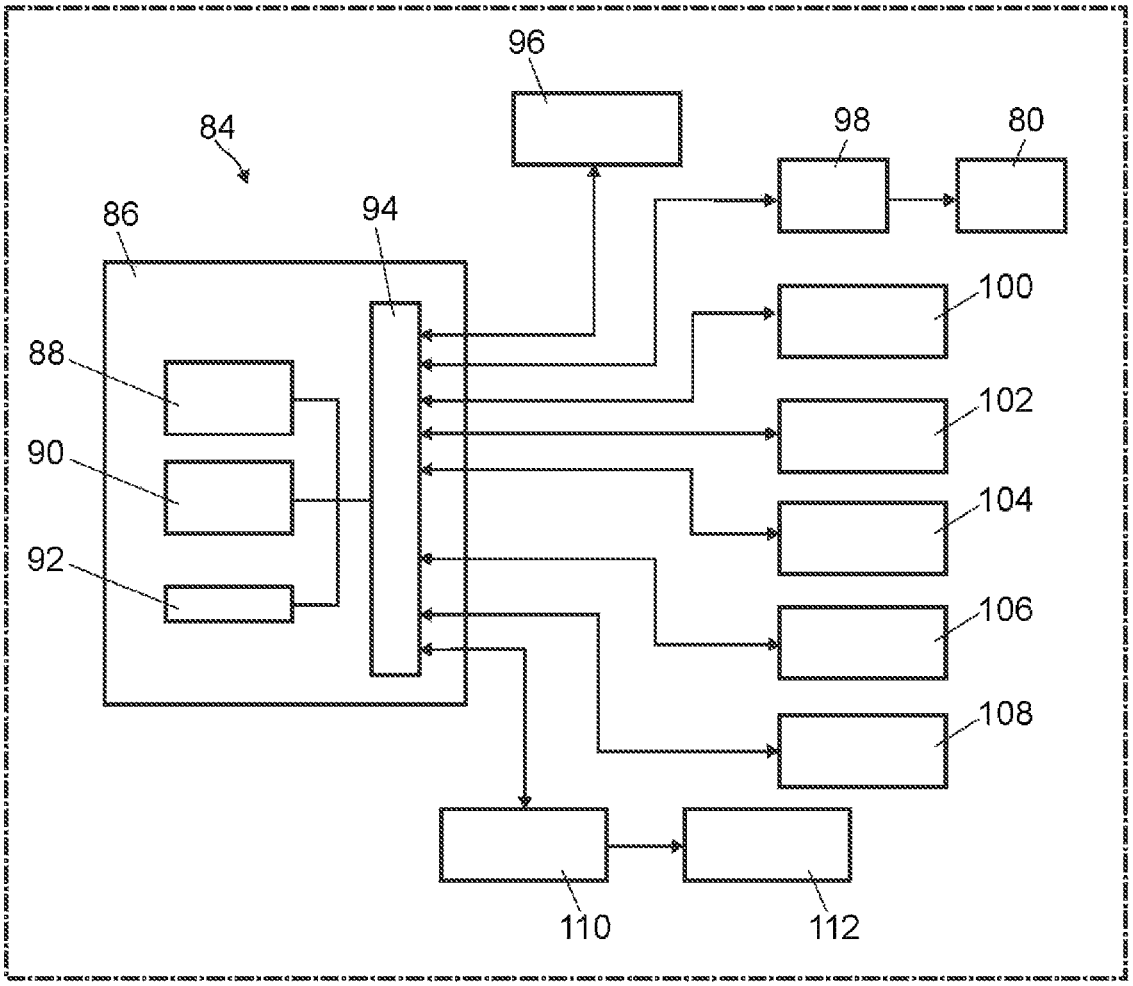
FIG. 7 is a system diagram in accordance with the present invention.

FIG. 7 shows a system diagram of the computer assembly 84. The computer assembly 84 includes a main board 86, program memory 88 being a computer readable medium, a main processor 90 and RAM 92 connected in operative communication. The computer 84 has an input output I/O controller 94. The I/O controller 94 communicates with a user interface control panel 96, display interface driver circuitry 98, a display unit 100, a coin acceptor 102, a bill acceptor 104, a card reader 106, a ticket reader/printer 108, and a sound circuit 110. The sound circuit 110 is in operative communication with speakers 112.

The coin acceptor 102 and the bill acceptor 104 accept currency and communicate the amount accepted to the I/O controller 94. The card reader 106 reads credit cards, debit cards, gift cards or other card having electronic indicia of monetary value.

The ticket reader 108 prints tickets and receipts revealing the winnings of a player, or other financial outcome. The ticket reader 108 also receives tickets having indicia of monetary value, such as a bar code, which is read by the ticket reader 108.

The sound circuit 110 is configured to provide an acoustic-based interface for the user. Each movement or action by a user may result in a particular sound, or instruction being generated by the computer 84. The speakers 112 communicate the sounds to the user.

While the present invention is disclosed in terms of various specific embodiments, it can be appreciated that these embodiments are by way of example only. There are several variations contemplated by the present invention, and with the popularity of electronic gaming interfaces, the term "reel" should be broadly understood to include any set of moveable images, defining a matrix column, that are used to establish a payout. The term "random" or "randomly" are to be broadly defined herein to include pseudo-random, or pseudo-randomly, respectively.

While the present invention describes tallying the spatial origins of wining combinations in a matrix of symbols relative to the left and right side of the display, and utilizing this data to influence payouts and rewards, the invention also includes tallying the spatial location and orientation of winning combinations of any gaming arrangement beyond matrices of symbols, and beyond the limitations of left and right. For example, the gauges may be adapted to reflect spatial origins of gaming event that arise in any location of the display. The gauges may also be repositioned on the display to optimally reflect any gaming combination having detection and recording of winning events having spatially correlated origins. It can also be appreciated that gaming machines typically include a two dimensional display, but gaming machines according to the present invention may also include a display with multiple layers and depth to form three dimensional images, symbols and combinations.

According to a further aspect of the invention the game and symbols may be directed to different themes at the same time. Advantageously a competition-like slot game may be realized having for example a Shogun (Samurai) themed symbol reel set on the left side and a Ninja themed symbol reel set on the right side. In another example the game themes may belong to two different clans on each side. There are a variety of themes imaginable, from the comic, series, fantasy, reality, etc.

While the current description shows a two dimensional display having a right and left side as points of reference, it can be appreciated that the term "spatial origins" is defined broadly as including spatial orientation, spatial alignment and spatial location of symbols relative to a display on a gaming machine. "Spatial origins" may be defined relative to any useable parameter of a two dimensional display or display having multiple layers, depth, and any of a variety of geometric shapes. For example, the present invention may be used with a three dimensional display having right, left and depth data tallied along with winning streak data. Accordingly, the scope of the invention is defined by the appended claims.

Although some embodiments described herein describe the game and/or methods as being implemented on EGMs such as slot machines and video poker machines, it should be understood that such embodiments may also be deployed on other devices such as on a general purpose computing device or mobile phone in stand-alone form or connected to a network, such as the internet. Further, although some embodiments are described herein in the context of a wagering game, it should be understood that accepting or processing wagers or a wagering environment is not necessary to all embodiments.

I claim:

1. A gaming machine for slot-machine game play comprising:

a kiosk for housing a computer assembly operatively connected with a primary display;

an input device configured to receive input from a player to initiate a game play;

the primary display having a right side and a left side, with a right gauge being output on the right side of the primary display and a left gauge being output on the left side of the primary display;

an array of symbols presented on the display between the right gauge and the left gauge to enable slot-machine game play, the array of symbols representing a reel set includes a left column, a right column, and at least one additional column between the right column and left column, the array of symbols yields the possibility of a winning combination of symbols in an reel set spin based on a random number generator, wherein the right gauge on the right side functions to count a number of winning combinations of symbols that have a spatial origin on the right column of the array of symbols and is positioned on the right side of the display to visually tie its output to the right column of the array of symbols and wherein the left gauge on the left side functions to count a number of winning combinations of symbols that have a spatial origin on the left column of the array of symbols and is positioned on the left side of the display to visually tie its output to the left column of the array of symbols;

when a winning combination of the symbols in the array of symbols is presented on the primary display, determining whether the winning combination of symbols includes the spatial origin on the left side of the array of symbols or the spatial origin on the right side of the array of symbols; and activating, based on the determining, one of the left gauge or the right gauge, wherein (i) the left gauge is activated if the winning combination of symbols includes spatial origin on the left side of the array of symbols, thereby visually indicating the spatial origin on the left side of the array of symbols for the winning combination of symbols; or (ii) the right gauge is activated if the winning combination of symbols includes spatial origin is on the right side of the array of symbols, thereby visually indicating the spatial origin on the right side of the array of symbols for the winning combination of symbols.

2. The gaming machine as set forth in claim 1, wherein the array of symbols comprises columns that appear to rotate, and wherein the right and left columns stop rotating first, and then at least one column adjacent the right and left columns stops rotating.

3. The gaming machine as set forth in claim 1, wherein the left gauge and right gauge have bars for tallying win streak data, and wherein one bar of a given gauge activates in response to one corresponding winning combination of symbols being output within the array of symbol.

4. The gaming machine as set forth in claim 3, wherein the left gauge and the right gauge each includes unlock indicators in alignment with the respective bars, wherein activation of a predetermined number of bars activates at least one of the unlock indicators, and further wherein activation of an unlock indicator enables a bonus possibility during game play.

5. The gaming machine as set forth in claim 4, wherein five bars of a given gauge being activated unlock a single unlock indicator and wherein the gaming machine has four unlock indicators on each of the right gauge and the left gauge.

6. The gaming machine as set forth in claim 1, wherein the spatial origin is selected from the group consisting of: the right side of the array of symbols, the left side of the array of symbols and combinations thereof.

7. The gaming machine as set forth in claim 2, wherein each column stops rotating at a different time.

8. A method for presenting data pertaining to win streak length and spatial origin of winning combinations in a gaming machine, comprising:

providing a kiosk for housing a computer assembly operatively connected with a primary display, the primary display having a right side and a left side, with a right gauge being output on the right side of the primary display and a left gauge being output on the left side of the primary display, the kiosk including a device for accepting and dispensing payments;

accepting a payment to initiate game play;

randomly presenting an array of symbols on the primary display, the array of symbols being positioned between the right gauge and the left gauge and having columns and rows including a left column, a right column, and at least one additional column between the left column and the right column, wherein the right gauge on the right side functions to count a number of winning combinations of symbols that have a spatial origin on the right column of the array of symbols and is positioned on the right side of the display to visually tie its output to the right column of the array of symbols and wherein the left gauge on the left side functions to count a number of winning combinations of symbols that have a spatial origin on the left column of the array of symbols and is positioned on the left side of the display to visually tie its output to the left column of the array of symbols;

when a winning combination of the symbols in the array of symbols is presented on the primary display, determining whether the winning combination of symbols includes the spatial origin on the left side of the array of symbols or the spatial origin on the right side of the array of symbols; and activating, based on the determining, one of the left gauge or the right gauge, wherein (i) the left gauge is activated if the winning combination of symbols includes spatial origin on the left side of the array of symbols, thereby visually indicating the spatial origin on the left side of the array of symbols for the winning combination of symbols; or (ii) the right gauge is activated if the winning combination of symbols includes spatial origin is on the right side of the array of symbols, thereby visually indicating the spatial origin on the right side of the array of symbols for the winning combination of symbols.

9. The method of claim 8, wherein the array of symbols comprises columns that appear to rotate, and wherein the right and left columns stop rotating first, and then the at least one additional column between the left column and the right column stops rotating.

10. The method of claim 8, wherein the left gauge and right gauge have bars for tallying win streak data, and wherein one bar of a given gauge activates in response to one a corresponding winning combination of symbols being output within the array of symbols.

11. The method of claim 10, wherein the left gauge and the right gauge each includes unlock indicators in alignment with the respective bars, wherein activation of a predetermined number of bars activates at least one of the unlock indicators, and further wherein activation of an unlock indicator enables a bonus possibility during game play.

12. The method of claim 11, wherein five bars of a given gauge being activated unlock a single unlock indicator and wherein the gaming machine has four unlock indicators on each of the right gauge and the left gauge.

13. The method of claim 8, wherein the spatial origin is selected from the group consisting of: the right side of the array of symbols, the left side of the array of symbols and combinations thereof.

14. The method of claim 8, wherein each column stops rotating at a different time.

* * * * *